US006050005A

United States Patent [19]

Dodge

[11] Patent Number: 6,050,005

[45] **Date of Patent: *Apr. 18, 2000**

[54] SNOWBOARD BOOT BINDING MECHANISM

[75] Inventor: David J. Dodge, Shelburne, Vt.

[73] Assignee: The Burton Corporation, Burlington, Vt.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/753,343

[22] Filed: Nov. 25, 1996

Related U.S. Application Data

[63] Continuation of application No. 08/674,976, Jul. 3, 1996, which is a continuation of application No. 08/375,971, Jan. 20, 1995, abandoned.

[51] Int. Cl.[7] ..... A43B 5/04

[52] U.S. Cl. ..... 36/117.3; 36/113; 280/613

[58] Field of Search ..... 36/113, 75 R, 36/73, 72 A, 131, 132, 136, 1, 107, 148, 103, 117.3; 280/613

[56] References Cited

U.S. PATENT DOCUMENTS

| | | | |
|---|---|---|---|
| Re. 26,972 | 10/1970 | Spademan . | |
| Re. 33,350 | 9/1990 | Stuart | 280/624 |
| 3,271,040 | 9/1966 | Spademan . | |
| 3,560,011 | 2/1971 | Spademan | 280/11.35 |
| 3,578,349 | 5/1971 | Edmund | 280/11.35 |
| 3,775,875 | 12/1973 | Dvorsky | 36/72 A |
| 3,779,570 | 12/1973 | Betschart, Jr. | 280/11.35 R |
| 3,797,841 | 3/1974 | McAusland | 280/11.35 |
| 3,824,713 | 7/1974 | Vaccari | 36/2.5 AL |
| 3,869,136 | 3/1975 | Jackson | 280/11.35 D |
| 3,884,492 | 5/1975 | Spademan | 280/11.35 R |
| 3,887,206 | 6/1975 | Salomon | 280/11.35 N |
| 3,900,204 | 8/1975 | Weber | 280/11.13 S |
| 3,957,280 | 5/1976 | Turnheim et al. | 280/613 |

(List continued on next page.)

FOREIGN PATENT DOCUMENTS

| | | |
|---|---|---|
| 255 325 | 11/1964 | Australia . |
| 0 059 022 A2 | 1/1982 | European Pat. Off. . |
| 2 628 981 | 9/1989 | France . |
| 3916233 A1 | 11/1990 | Germany . |
| 296 01 682 U | 5/1996 | Germany . |
| 303728 | 11/1995 | Japan . |
| 678494 A5 | 9/1991 | Switzerland . |
| WO 94/26365 | 11/1994 | WIPO . |
| WO 95/09035 | 4/1995 | WIPO . |
| WO 95/33533 A1 | 12/1995 | WIPO . |
| WO 96/01575 | 1/1996 | WIPO . |
| WO 96/03185 A1 | 2/1996 | WIPO . |
| WO 96/05894 | 2/1996 | WIPO . |
| WO 96/17660 A1 | 6/1996 | WIPO . |
| WO 96/26774 | 9/1996 | WIPO . |
| WO 96/36407 | 11/1996 | WIPO . |
| WO 97/04843 | 2/1997 | WIPO . |

*Primary Examiner*—M. D. Patterson
*Assistant Examiner*—J. Mohandesi
*Attorney, Agent, or Firm*—Wolf, Greenfield & Sacks, P.C.

[57] ABSTRACT

A snowboard boot binding mechanism includes a base member having a recessed channel. A first plate is slidably attached to the base member. A first pair of engagement rods are fixedly attached to the first plate. Each of the first pair of engagement rods has a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods have a head disposed at an axial end of the rod for engaging and locking a second bar attached to a second side of the snowboard boot which is disposed opposite to the first side.

124 Claims, 3 Drawing Sheets

U.S. PATENT DOCUMENTS

| | | | |
|---|---|---|---|
| 3,964,758 | 6/1976 | Kent | 280/613 |
| 3,988,841 | 11/1976 | Salomon | 36/117 |
| 4,026,045 | 5/1977 | Druss | 36/108 |
| 4,042,257 | 8/1977 | Salomon | 280/624 |
| 4,063,752 | 12/1977 | Whitaker et al. | 280/624 |
| 4,168,085 | 9/1979 | Faulin | 280/618 |
| 4,177,584 | 12/1979 | Beyl | 36/117 |
| 4,182,525 | 1/1980 | Spademan | 280/624 |
| 4,261,595 | 4/1981 | Smialowski et al. | 280/614 |
| 4,270,770 | 6/1981 | Spademan | 280/624 |
| 4,352,508 | 10/1982 | Spademan | 280/624 |
| 4,395,055 | 7/1983 | Spademan | 280/624 |
| 4,415,176 | 11/1983 | Hull et al. | 280/612 |
| 4,492,387 | 1/1985 | Spademan | 280/624 |
| 4,536,006 | 8/1985 | Haldemann et al. | 36/117.3 X |
| 4,571,858 | 2/1986 | Faulin | 36/117.3 X |
| 4,652,007 | 3/1987 | Dennis | 280/618 |
| 4,728,116 | 3/1988 | Hill | 280/124 |
| 4,741,550 | 5/1988 | Dennis | 280/618 |
| 4,964,649 | 10/1990 | Chamberlin | 280/618 |
| 4,973,073 | 11/1990 | Raines et al. | 280/624 |
| 4,995,632 | 2/1991 | Girault et al. | 280/615 |
| 5,035,443 | 7/1991 | Kincheloe | 280/618 |
| 5,054,807 | 10/1991 | Fauvet | 280/607 |
| 5,069,463 | 12/1991 | Baud et al. | 280/14.2 |
| 5,299,823 | 4/1994 | Glaser | 280/625 |
| 5,474,322 | 12/1995 | Perkins et al. | 280/613 |
| 5,505,477 | 4/1996 | Turner et al. | 280/613 |
| 5,520,405 | 5/1996 | Bourke | 280/613 |
| 5,520,406 | 5/1996 | Anderson et al. | 280/624 |
| 5,558,355 | 9/1996 | Henry | 280/624 |
| 5,577,757 | 11/1996 | Riepl et al. | 280/624 |
| 5,595,396 | 1/1997 | Bourdeau | 280/607 |

SNOWBOARD BOOT BINDING MECHANISM

This application is a continuation of application Ser. No. 08/674,976, filed Jul. 3, 1996, entitled SNOWBOARD BOOT BINDING MECHANISM, now pending, which is a File Wrapper Continuation of application Ser. No. 08/375,971, filed Jan. 20, 1995, now abandoned.

BACKGROUND OF THE INVENTION

1. Field of the Invention

The present invention relates generally to boot binding mechanisms. More specifically, the present invention relates to a snowboard boot binding mechanism that has a pair of engagement rods fixedly attached to a fixed plate and a second pair of engagement rods fixedly attached to a slidably movable plate to selectively engage and lock a snowboard boot in the boot binding mechanism.

2. Description of the Related Art

A recently popular sport, snowboarding presents operating conditions and physical demands to boot bindings that are somewhat dissimilar to other skiing-type sports. That is because in snowboarding, the operator stands with both feet on the snowboard such that both feet are typically disposed at an angle with respect to the longitudinal direction of the ski. Given the sophisticated structure of presently manufactured boots for ski-type sports and the operating conditions the boots are subject to, a reliable and tight connection in between the boot and the snowboard is required.

An attempted solution to this problem is disclosed in U.S. Pat. No. 4,973,073 to Raines et al., issued on Nov. 27, 1990. The boot sole 40 of Raines is modified to have a binding ridge 42, 50 placed on each side of the boot. Ridge 42 is received in a fixed entrapment member 60 and ridge 50 is received by a pivoting entrapment member 70. To release a bound boot 18, the user simply pushes the handle 102 away from the boot until the hooking lip 76 is in an open position and the second binding bridge 50 can be lifted out of the second socket 72. Accordingly, during use the snowboard binding can be rather easily inadvertently opened if handle 102 or any part of member 70 is accidentally pushed away from the boot.

U.S. Pat. No. 4,063,752 to Whittaker issued on Dec. 20, 1977 discloses a ski binding that includes two opposing latch members 28 that each move towards and away from each other to control the latch operation. An engagement plate 32 is secured to the bottom of the boot by screws and has latch receiving formations 34 disposed at its marginal edges.

Notwithstanding the foregoing boot binding mechanisms, there are still major problems involved. The binding mechanisms are typically mounted on the ski or snowboard and are disposed in such a matter that outside forces can easily cause an accidental release of the binding mechanism. Accordingly, it is an object of the present invention to provide a snowboard boot binding mechanism that permits selective engagement and locking of the snowboard boot while simultaneously preventing an inadvertent release of the boot from the locked position. It is a further object of the present invention to provide a boot binding mechanism that includes a base member which acts as a housing to enclose most of the moving parts of the boot binding mechanism to thereby minimize the risk of an accidental release of the binding from the locked position. It is a further object to provide a boot binding mechanism that permits the binding mechanism to clamp the boot sole from the side, i.e., from the in-step area of the foot. It is a further object to provide a snowboard boot binding mechanism that requires less parts and thus, is smaller and easier to manufacture. It is still a further object of the present invention that the snowboard boot binding mechanism be simple and cost effective to manufacture, yet reliable and efficient in use.

SUMMARY OF THE INVENTION

In accordance with a preferred embodiment demonstrating further objects, features and advantages of the invention, a snowboard boot binding mechanism includes a a base member having a recessed channel. A first plate is slidably attached to the base member. A first pair of engagement rods are fixedly attached to the first plate. Each of the first pair of engagement rods have a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods having a head disposed at an axial end of the rod for engaging and locking a second bar attached to a second side of the snowboard boot which is disposed opposite to the first side.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
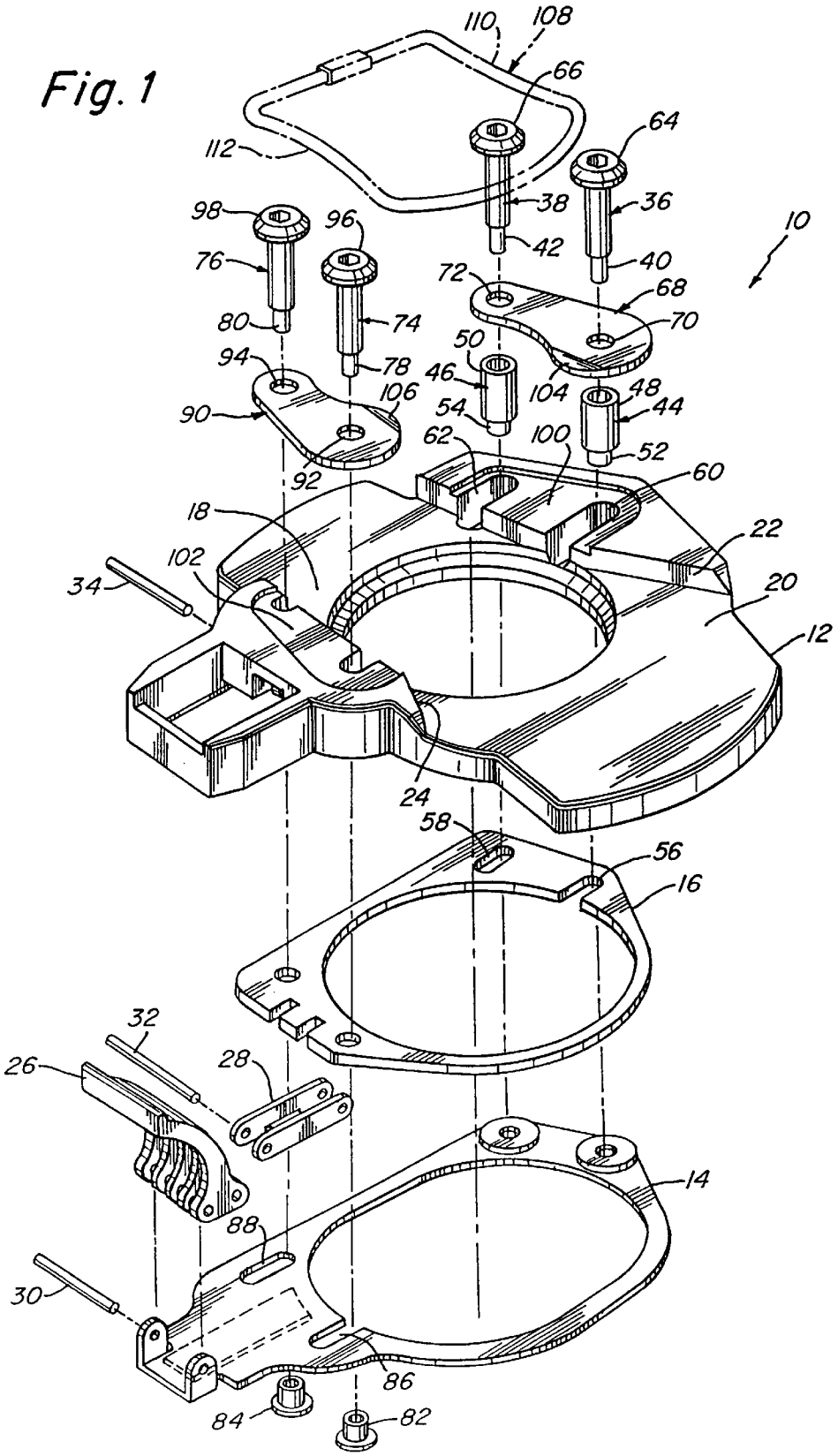
FIG. 1 is an exploded view of a boot binding mechanism according to the present invention.

Referring now to FIG. 1, a snowboard boot binding mechanism 10 is illustrated. The boot binding mechanism includes a base member 12, a first plate 14 and a second plate 16. The base member 12 has a recessed channel 18 that includes an upper surface 20 and two sidewalls surfaces 22, 24 to receive a snowboard boot.

The first plate 14 is slidably attached to base member 12 through a pivoting handle member 26 and a pivoting link arm member 28. A pin 30 is used to pivotally connect handle member 26 to first plate 14. A second pin 32 is used to pivotally connect handle member 26 to link 28. The opposite end of link 28 is pivotally connected to base member 12 by pin 34.

A first pair of engagement rods 36, 38 are fixedly attached to first plate 14. The rods 36, 38 are integrally connected to first plate 14 at their lower axially ends 40, 42, respectively; it being understood that relative orientation adjectives such as "upper", "lower", etc. are utilized herein to simplify the present description and are not intended to limit the orientation of the binding mechanism when mounted for use. The rods 36, 38 are preferably connected to plate 14 by riveting.

However, any other suitable means for fixedly attaching the rods to the plate may be used. Each rod 36, 38 passes through a spacer sleeve 44, 46, respectively. Each spacer sleeve 44, 46 has a stepped outer diameter portion including a larger diameter portion 48, 50 and a smaller diameter portion 52, 54, respectively. The smaller diameter portions 52, 54 are received in elongated slots 56, 58, respectively in second plate 16, whereas the larger diameter portions 44, 46 are received in elongated slots 60, 62, respectively, in the base member 12. The upper axially ends of the rods 36, 38 have a head or plate-shaped portion 64, 66. An engagement plate 68 has a pair of throughholes 70, 72 to receive the larger diameter portion of rods 36, 38. Thus, engagement plate 68 is disposed about engagement rods 36, 38 and between head portions 64, 66 and spacer sleeves 44, 46. The spacer sleeves are utilized to help absorb some of the bending forces that may be applied against rods 36, 38. Additionally, engagement plate 68 is used to help transfer some of the bending forces that may be applied to rods 36, 38 into tensile forces. Of course, axial forces in rods 36, 38 are preferred over bending forces.

Figure 2:
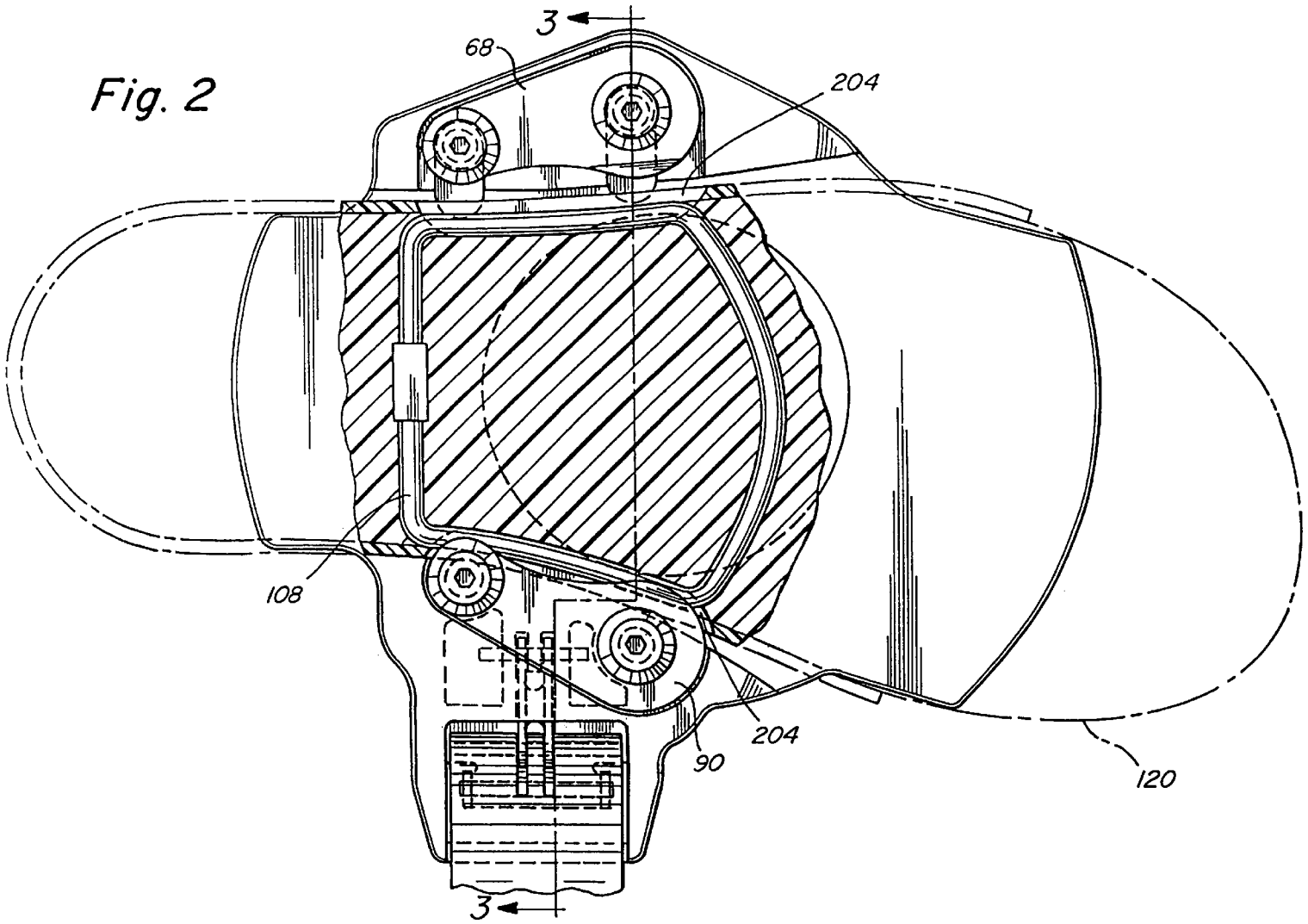
FIG. 2 is a partial sectional top view of a snowboard boot engaged in the boot binding mechanism and in the unlocked position.
Figure 3:
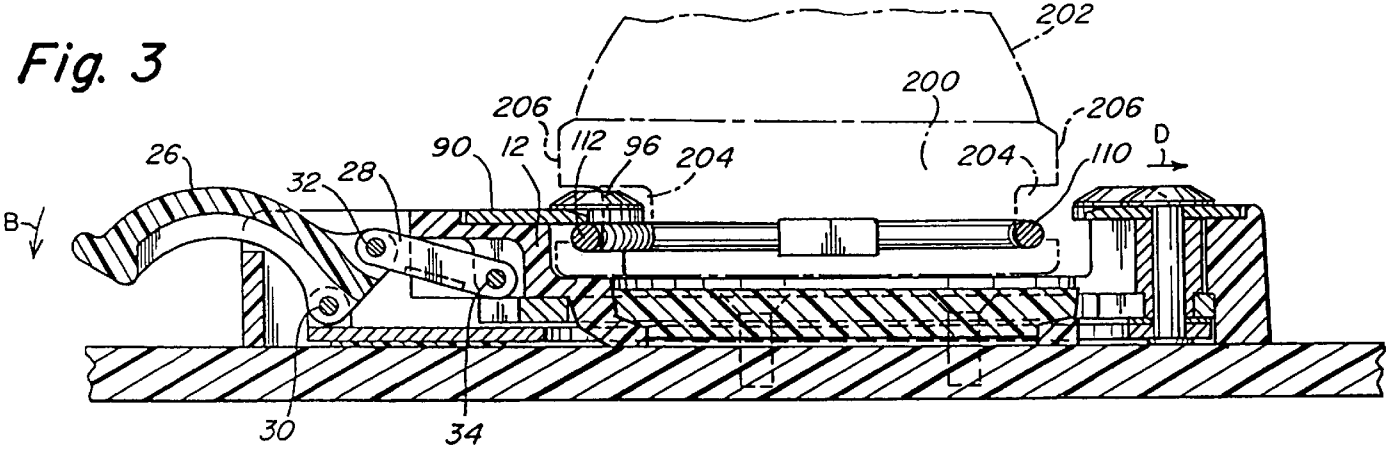
FIG. 3 is a sectional view taken along lines 3—3 of FIG. 2 and looking the direction of the arrows.
Figure 4:
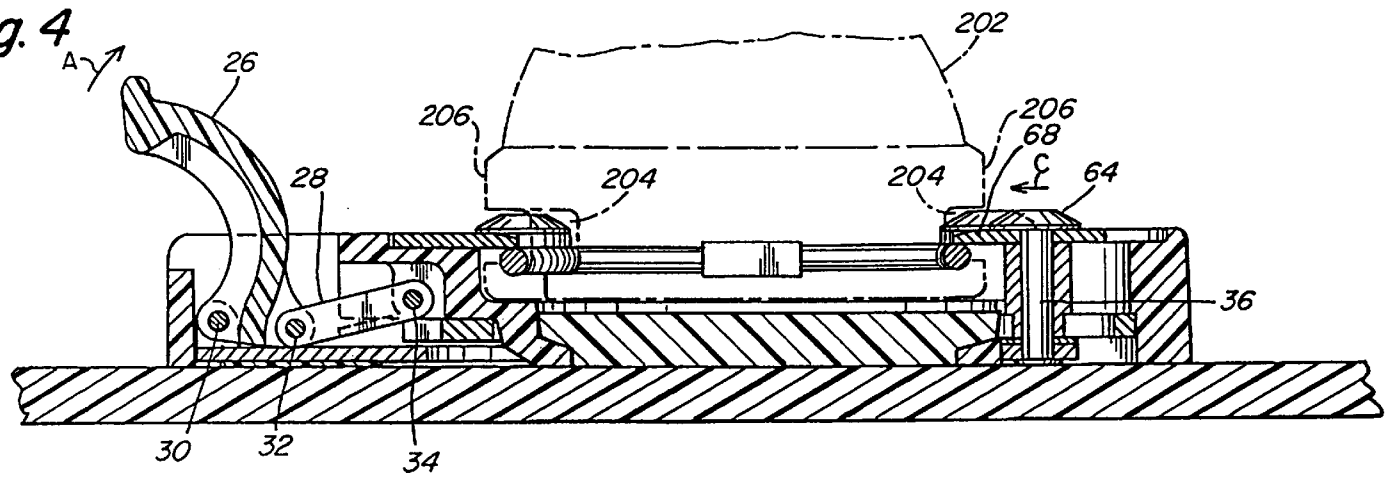
FIG. 4 is a sectional view similar to FIG. 3 except that the boot binding mechanism is in the locked position.

A second pair of engagement rods 74, 76 are fixedly attached to second plate 16 in a similar manner in which the first pair of engagement rods 36, 38 are fixedly attached to the first plate 14. The pairs of engagement rods are preferably fixedly attached to the plates by a press fit. However, any suitable manner of fixedly attaching these two members together such as welding, shrink-fitting, etc. may be used. The lower ends 78, 80, respectively of the second pair of engagement rods 74, 76 have a reduced diameter portion which are sized to fit within a pair of shoulder bushings 82, 84. The shoulder bushings 82, 84 help guide a sliding motion of the first plate 14 because they are received in elongated slots 86, 88, respectively. A second engagement plate 90 is mounted about the second pair of engagement rods 74, 76 via their respective throughholes 92, 94. Engagement plate 90 is mounted just below the heads 96, 98 of the engagement rods 74, 76, respectively. Engagement plate 68 is slidably supported on a slightly recessed, substantially planer surface 100 in base member 12. Likewise, engagement plate 90 is slidably supported on a slightly recessed, substantially planer support surface 102. Plates 68, 90, also have bevelled edge portions 104, 106 to permit a bar member 108, which is in the form of a closed loop and is embedded in a sole 200 of snowboard boot, to more easily engage into a position below plate 68 90. Bar member 108 has at least two exposed side portions 110, 112, which correspond to the in-step area of the user's foot. The side portions 110, 112 of the bar member 108 are exposed by a pair of recesses 204. In the embodiment of the invention shown in the drawings, the recesses 204 are disposed in the in-step area of the sole 200 of the boot, and extend only partially across the width of the boot as shown in FIGS. 3–4. Bar member 108 may alternatively not be embedded in the sole, but may be connected to the sole of the snowboard boot, with or without a reinforcing plate depending on the stresses that will be applied to the bar. Side portions 110, 112 are exposed at least along their upper surface, as illustrated in FIGS. 3 and 4 so that the upper portion of the side 110 can be selectively engaged with the first pair of engagement rods 36 and 38 such that the head portions 64, 66 and the engagement plate 68 lock the boot in the binding mechanism as illustrated in FIG. 4. The opposite side 112 of the bar member 108 is exposed along its upper surface to permit head portions 96, 98 of the second pair of engagement rods 74, 76 and engagement plate 90 to engage and to lock the snowboard boot in the binding mechanism when the first plate is in the locked position as illustrated in FIG. 4. As shown from FIGS. 2–4, the bar member 108 is disposed between the heel and ball areas of the boot, and does not extend beyond the lateral sidewalls 206 of the boot, such that the bar 108 is contained within the boundaries of the boot without extending beyond its lateral sides.

The operation of the boot binding mechanism will be described below with reference to FIGS. 2–4. A user wearing a snowboard boot 120 having an upper portion 202 and a closed loop bar member 108 embedded in its sole steps within the open binding mechanism and positions the second side 112 of the bar member 108 into the engaged position below heads 96, 98 and below engagement plate 90 as illustrated in FIGS. 2 and 3.

The lock the boot within the binding mechanism the user then pulls upwardly on handle member 26 in the direction indicated by arrow A in FIG. 4. This upper movement of handle member 26 causes handle member 26 to rotate in the direction indicated by arrow A and to translate in a direction indicated by arrow C in FIG. 4. At the same time, link member 28 pivots about fixed pin 34 in the direction indicated by arrow B, which is opposite to the direction of arrow A. Additionally, simultaneously with the pivoting movements, first plate 14 is slidably moved in the direction indicated by arrow C from the open position as illustrated in FIG. 3 to the closed position as illustrated in FIG. 4. As can be seen in FIGS. 3 and 4, as handle member 26 is pivoted in the upward position, pivot pin 30 slides in the direction indicated by arrow C. When pin 32 passes over an imaginary line extending between pins 30, 34, the handle reaches what is known as a centered position. In this centered position the handle is instable and the handle will then tend to snap into the closed position as illustrated in FIG. 4. In the closed position, the handle is in what is known as an over-centered position. The first set of engagement rods 36, 38 are moved from the open position as illustrated in FIG. 3 to the closed position as illustrated in FIG. 4, such that the heads 64, 66 and the engagement plate 68 selectively engage and lock the first side 110 of the bar member 108 in the boot binding mechanism. If desired, a conventional latch (not shown) may be placed onto handle member 26 to further prevent an inadvertent pivoting of the handle member. However, in most cases the pressure applied from the boot and the base member will be sufficient to maintain the handle in the stable, over-centered position illustrated in FIG. 4.

To unlock the boot, the user simply pushes down and rotates handle member 26 in the direction indicated by arrow B in FIG. 3. Because of the linkage mechanism, this movement will cause handle member 26 to rotate in the direction indicated by arrow B and to translate in the direction indicated by arrow D. Thus, because of the link between the first plate 14 and the handle member 26, the second plate 14 is slidably moved in the direction indicated by arrow D to the open position as illustrated in FIG. 3. The user can now simply step out of the boot binding mechanism.

Having described the presently preferred exemplary embodiment of a new and improved snowboard boot binding mechanism, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What is claimed is:

1. An apparatus, comprising:

a snowboard boot having an upper portion and a sole, the sole having a heel-to-toe direction and a side-to-side direction; and a binding engagement member supported within the sole and having a portion thereof extending in the heel-to-toe direction which is engageable with a snowboard binding to secure the snowboard boot to a snowboard;

wherein the binding engagement member includes a first section that extends along a first side of the snowboard boot and a second section that extends along a second side of the snowboard boot, and wherein the first and second sections diverge away from each other in the heel-to-toe direction.

2. An apparatus, comprising:

a snowboard boot having an upper portion and a sole, the sole having a heel-to-toe direction and a side-to-side direction; and a binding engagement member supported within the sole and having a portion thereof extending in the heel-to-toe direction which is engageable with a snowboard binding to secure the snowboard boot to a snowboard;

wherein the binding engagement member is in the form of a closed loop.

3. An apparatus, comprising:

a snowboard boot having an upper portion and a sole, the sole having a heel-to-toe direction and a side-to-side direction; and a binding engagement member supported within the sole and having a portion thereof extending in the heel-to-toe direction which is engageable with a snowboard binding to secure the snowboard boot to a snowboard;

wherein the portion of the binding engagement member includes a first section which extends along a first side of the snowboard boot;

wherein the portion of the binding engagement member further includes a second section which extends along a second side of the snowboard boot;

wherein the sole includes a first side and a second side that each extends between a toe portion and a heel portion of the boot, and the first section of the binding engagement member is attached to the first side of the sole;

wherein the second section of the binding engagement member is attached to the second side of the sole; and wherein the binding engagement member includes at least one cross member interconnecting the first and second sections thereof.

4. The apparatus recited in claim 3, wherein the first cross member has a first length and the second cross member has a second length that is less than the first length.

5. The apparatus recited in claim 4, wherein the first cross member is arcuate.

6. An apparatus, comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the snowboard boot includes a heel-to-toe direction and a side-to-side direction, and wherein the portion of the at least one binding engagement member extends in the heel-to-toe direction and is circular in a cross-section taken in the side-to-side direction.

7. The apparatus recited in claim 6, wherein the at least one recess includes first and second recesses respectively disposed on first and second lateral sides of the snowboard boot, and wherein the at least one binding engagement member includes first and second engagement members that are respectively exposed by the first and second recesses.

8. The apparatus recited in claim 7, wherein the snowboard boot has an upper portion and a sole, and wherein the at least one binding engagement member is embedded in the sole of the snowboard boot.

9. The apparatus recited in claim 8, wherein the snowboard boot includes an in-step region, and wherein the at least one recess is disposed in the in-step region of the snowboard boot.

10. The apparatus recited in claim 7, wherein the snowboard boot includes an in-step region, and wherein the at least one recess is disposed in the in-step region of the snowboard boot.

11. The apparatus recited in claim 6, wherein the snowboard boot includes an in-step region, and wherein the at least one recess is disposed in the in-step region of the snowboard boot.

12. The apparatus recited in claim 11, wherein the at least one engagement member is a bar.

13. The apparatus of claim 11, in combination with the snowboard binding.

14. The apparatus recited in claim 6, wherein the at least one engagement member is a bar.

15. The apparatus recited in claim 6, wherein the at least one recess includes first and second recesses respectively disposed on first and second lateral sides of the snowboard boot, and wherein the at least one binding engagement member includes first and second engagement members that are respectively exposed by the first and second recesses, the first and second engagement members being formed from a single unitary member.

16. The apparatus recited in claim 15, wherein the entire single unitary member is disposed between the heel and ball areas of the snowboard boot.

17. The apparatus recited in claim 15, wherein the snowboard boot has an upper portion and a sole, and wherein the first and second binding engagement members are embedded in the sole of the snowboard boot.

18. The apparatus recited in claim 15, wherein the snowboard boot includes an in-step region, and wherein the first and second recesses are disposed in the in-step region of the snowboard boot.

19. The apparatus recited in claim 15, wherein the first and second engagement members are contained within the boundaries of the snowboard boot without extending beyond the lateral sides of the snowboard boot.

20. The apparatus of claim 15, in combination with the snowboard binding.

21. The apparatus recited in claim 15, wherein the single unitary member includes a closed loop.

22. The apparatus recited in claim 6, wherein the snowboard boot includes an in-step region, and wherein the at least one recess is disposed in the in-step region of the snowboard boot.

23. The apparatus of claim 6, in combination with the snowboard binding.

24. An apparatus, comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the snowboard boot includes a heel-to-toe direction and a side-to-side direction, wherein the portion of the at least one binding engagement member that is engageable with the snowboard binding extends in the heel-to-toe direction, and wherein the binding engagement member is contained within the boundaries of the snowboard boot without extending beyond the lateral side of the snowboard boot.

25. The apparatus recited in claim 24, wherein the snowboard boot includes an in-step region, and wherein the at least one recess is disposed in the in-step region of the snowboard boot.

26. The apparatus recited in claim 25, wherein the at least one engagement member is a bar.

27. An apparatus, comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the at least one recess includes first and second recesses respectively disposed on first and second lateral sides of the snowboard boot, and wherein the at least one binding engagement member includes first and second engagement members that are respectively exposed by the first and second recesses, the first and second engagement members being formed from a single unitary member;

wherein the single unitary member is a closed loop.

28. The apparatus recited in claim 27, wherein the closed loop is a bar.

29. An apparatus, comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the snowboard boot has an upper portion and a sole, and wherein the at least one binding engagement member is embedded in the sole of the snowboard boot; and wherein the snowboard boot includes a heel-to-toe direction and a side-to-side direction, and wherein the portion of the at least one binding engagement member extends in the heel-to-toe direction and is circular in a cross-section taken in the side-to-side direction.

30. The apparatus recited in claim 29, wherein the snowboard boot includes an in-step region, and wherein the at least one recess is disposed in the in-step region of the snowboard boot.

31. An apparatus, comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the at least one recess includes first and second recesses respectively disposed on first and second lateral sides of the snowboard boot, and wherein the at least one binding engagement member includes first and second engagement members that are respectively exposed by the first and second recesses;

wherein the snowboard boot includes an in-step region, and wherein the at least one recess is disposed in the in-step region of the snowboard boot; and wherein the snowboard boot includes a heel-to-toe direction and a side-to-side direction, and wherein the portion of the at least one binding engagement member extends in the heel-to-toe direction and is circular in a cross-section taken in the side-to-side direction.

32. An apparatus, comprising:

a snowboard boot including at least one recess disposed on a lateral side of the snowboard boot; and at least one binding engagement member, supported by the snowboard boot, having a portion thereof that is exposed by the at least one recess and is engageable with a snowboard binding to secure the snowboard boot to a snowboard;

wherein the at least one recess includes first and second recesses respectively disposed on first and second lateral sides of the snowboard boot, and wherein the at least one binding engagement member includes first and second engagement members that are respectively exposed by the first and second recesses, the first and second engagement members being formed from a single unitary member; and wherein the single unitary member is a closed loop.

33. The apparatus recited in claim 32, wherein the snowboard boot includes a heel region and a ball region, and wherein the entire closed loop is disposed between the heel and ball regions of the snowboard boot.

34. The apparatus of claim 33, in combination with the snowboard binding.

35. The apparatus recited in claim 33, wherein the snowboard boot includes a heel-to-toe direction and a side-to-side direction, wherein the portion of the first binding engagement member that is engageable with the snowboard binding extends in the heel-to-toe direction and is circular in a cross-section taken in the side-to-side direction, and wherein the portion of the first binding engagement member that is engageable with the snowboard binding extends in the heel-to-toe direction and is circular in a cross-section taken in the side-to-side direction.

36. An apparatus, comprising:

a snowboard boot having an upper portion and a sole, the snowboard boot having a ball region and a heel region, the snowboard boot including first and second recesses respectively disposed on first and second lateral sides of the snowboard boot, each of the first and second recesses being disposed between the ball and heel regions of the snowboard boot;

a first binding engagement member, embedded in the sole of the snowboard boot, having a portion thereof that is exposed by the first recess and is engageable with a snowboard binding to secure the snowboard boot to a snowboard; and a second binding engagement member, embedded in the sole of the snowboard boot, having a portion thereof that is exposed by the second recess and is engageable with the snowboard binding to secure the snowboard boot to the snowboard;

wherein the first and second engagement members are part of a single unitary member;

wherein the single unitary member is a bar; and wherein the single unitary member is a closed loop.

37. The apparatus recited in claim 36, wherein the single unitary member is circular in cross-section.

38. The apparatus recited in claim 37, wherein the entire single unitary member is disposed between the heel and ball areas of the snowboard boot.

39. The apparatus recited in claim 38, wherein the single unitary member is embedded in the sole of the snowboard boot such that the single unitary member does not extend beyond the lateral sides of the snowboard boot.

40. The apparatus of claim 36, in combination with the snowboard binding.

41. The apparatus recited in claim 36, wherein the single unitary member includes a closed loop.

42. An apparatus, comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot, the engageable portion of the at least one engagement member being a bar;

wherein the engageable portion of the at least one engagement member is circular in a cross-section taken in the side-to-side direction.

43. The apparatus recited in claim 42, wherein the engageable portion of the at least one engagement member extends in the heel-to-to direction.

44. The apparatus recited in claim 43, wherein the snowboard boot includes an in-step region, and wherein the engageable portion of the least one engagement member is disposed in the in-step region of the snowboard boot.

45. The apparatus recited in claim 42, wherein the snowboard boot includes an in-step region, and wherein the engageable portion of the at least one engagement member is disposed in the in-step region of the snowboard boot.

46. The apparatus of claim 45, in combination with the snowboard binding.

47. The apparatus recited in claim 45, wherein the binding engagement member forms a stiffener that stiffens the sole, and that does not extend forward of an instep region of the sole so as to not impact flexibility of the sole forward of the instep region.

48. The apparatus recited in claim 42, wherein the apparatus has a recess that exposes the engageable portion of the at least one engagement member.

49. The apparatus recited in claim 42, wherein the at least one engagement member is integrated into the snowboard boot.

50. The apparatus recited in claim 42, wherein the at least one engagement member is connected to the sole of the snowboard boot without being embedded therein.

51. The apparatus recited in claim 50, wherein the apparatus has a recess that exposes the engageable portion of the at least one engagement member.

52. The apparatus recited in claim 51, wherein the snowboard boot includes an in-step region, and wherein the engageable portion of the at least one engagement member is disposed in the in-step region of the snowboard boot.

53. The apparatus recited in claim 42, wherein the at least one binding engagement member includes first and second binding engagement members that respectively have engageable portions that are disposed substantially in-line with the first and second lateral sidewalls of the snowboard boot, the engageable portions of each of the first and second binding engagement members being a bar.

54. The apparatus recited in claim 53, wherein the engageable portions of the first and second binding engagement members are circular in cross-section.

55. The apparatus recited in claim 52, wherein each of the first and second binding engagement members is connected to the sole of the snowboard boot without being embedded therein.

56. The apparatus recited in claim 55, wherein the apparatus has at least one recess that exposes the engageable portions of the first and second binding engagement members.

57. The apparatus recited in claim 56, wherein the snowboard boot includes an in-step region, and wherein the engageable portions of the first and second binding engagement members each is disposed in the in-step region of the snowboard boot.

58. The apparatus recited in claim 57, wherein the engageable portions of the first and second binding engagement members each extends in the heel-to-to direction.

59. The apparatus recited in claim 53, wherein the engageable portions of the first and second binding engagement members each extends in the heel-to-to direction.

60. The apparatus of claim 42, in combination with the snowboard binding.

61. The apparatus recited in claim 42, wherein the engageable portion of the at least one engagement member is disposed substantially in-line with the one of the first and second lateral sidewalls of the snowboard boot.

62. An apparatus, comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot;

wherein the apparatus includes at least one recess that is adapted to expose the engageable portion of the at least one engagement member, the engageable portion of the at least one engagement member being disposed within the recess;

wherein the engageable portion of the at least one engagement member extends in the heel-to-to direction; and wherein the engageable portion of the at least one engagement member is circular in cross-section.

63. The apparatus recited in claim 62, wherein the engageable portion of the at least one engagement member is a bar.

64. The apparatus recited in claim 63, wherein the snowboard boot includes an in-step region, and wherein the engageable portion of the at least one engagement member is disposed in the in-step region of the snowboard boot.

65. The apparatus recited in claim 64, wherein the at least one engagement member is connected to the sole of the snowboard boot without being embedded therein.

66. The apparatus recited in claim 62, wherein the at least one engagement member is connected to the sole of the snowboard boot without being embedded therein.

67. The apparatus recited in claim 62, wherein the at least one engagement member is integrated into the snowboard boot.

68. The apparatus recited in claim 62, wherein the at least one binding engagement member includes first and second binding engagement members that respectively have engageable portions that are disposed substantially in-line with the first and second lateral sidewalls of the snowboard boot and that each extends in the heel-to-toe direction, the engageable portions of each of the first and second binding engagement members being exposed by the at least one recess.

69. The apparatus recited in claim 68, wherein the engageable portions of the first and second binding engagement members each is circular in cross-section.

70. The apparatus of claim 62, in combination with the snowboard binding.

71. An apparatus, comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot;

wherein the apparatus includes at least one recess that is adapted to expose the engageable portion of the at least one engagement member, the engageable portion of the at least one engagement member being disposed within the recess;

wherein the at least one binding engagement member includes first and second binding engagement members that respectively have engageable portions that are disposed substantially in-line with the first and second lateral sidewalls of the snowboard boot and that each extends in the heel-to-toe direction, the engageable portions of each of the first and second binding engagement members being exposed by the at least one recess;

wherein the engageable portions of the first and second binding engagement members each is circular in cross-section; and wherein each of the first and second binding engagement members is connected to the sole of the snowboard boot without being embedded therein.

72. The apparatus recited in claim 41, wherein the engageable portions of the first and second binding engagement members each is a bar.

73. The apparatus recited in claim 72, wherein the snowboard boot includes an in-step region, and wherein the engageable portions of the first and second binding engagement members each is disposed in the in-step region of the snowboard boot.

74. The apparatus recited in claim 73, wherein the engageable portions of the first and second binding engagement members each extends in the heel-to-to direction.

75. An apparatus, comprising:

a snowboard boot having an upper portion and a sole, the boot having first and second lateral sidewalls; and at least one binding engagement member, connected to the sole, having a portion thereof that is engageable with a snowboard binding to secure the snowboard boot to a snowboard, the engageable portion of the at least one binding engagement member being a bar that is circular in cross-section and is contained between the first and second lateral sidewalls of the boot without extending beyond either of the first and second lateral sidewalls;

wherein the engageable portion of the at least one binding engagement member extends in a heel-to-toe direction of the snowboard boot, and wherein the bar is circular in a cross-section taken in a side-to-side direction of the snowboard boot.

76. The apparatus recited in claim 75, wherein the at least one binding engagement member is embedded in the sole.

77. The apparatus recited in claim 75, wherein the sole includes a recess that exposes the engageable portion of the at least one binding engagement member.

78. The apparatus recited in claim 77, wherein the recess is disposed in the first lateral sidewall of the boot.

79. The apparatus of claim 75, in combination with the snowboard binding.

80. An apparatus comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being a bar that extends in the heel-to-to direction and is circular in cross-section in the side-to-side direction;

in combination with the snowboard binding.

81. The apparatus recited in claim 80, wherein the apparatus has a recess that exposes the engageable portion of the at least one engagement member.

82. The apparatus recited in claim 80, wherein the at least one engagement member is connected to the sole of the snowboard boot without being embedded therein.

83. The apparatus recited in claim 80, wherein the apparatus includes first and second lateral sidewalls, and wherein the at least one binding engagement member is contained between the first and second lateral sidewalls of the apparatus without extending beyond either of the first and second lateral sidewalls.

84. The apparatus recited in claim 80, wherein the engageable portion of the at least one binding engagement member extends along at least one of the first and second lateral sidewalls.

85. The apparatus recited in claim 84, wherein the at least one binding engagement member is connected to the sole of the snowboard boot.

86. The apparatus recited in claim 85, wherein the at least one binding engagement member includes first and second binding engagement members each having an engageable portion, the engageable portions of the first and second binding engagement members respectively extending along the first and second lateral sidewalls of the snowboard boot.

87. The apparatus recited in claim 86, further including a closed loop that includes the engageable portions of the first and second binding engagement members.

88. The apparatus recited in claim 84, wherein the engageable portion of the at least one binding engagement member is substantially in-line with the at least one of the first and second lateral sidewalls along which it extends.

89. An apparatus, comprising:

a snowboard boot having an upper portion and a sole, the sole having a heel-to-toe direction and a side-to-side direction; and a binding engagement member supported within the sole and having a portion thereof extending in the heel-to-toe direction which is engageable with a snowboard binding to secure the snowboard boot to a snowboard;

wherein the portion of the binding engagement member that extends in the heel-to-toe direction and is engageable with the snowboard binding is circular in a cross-section taken in the side-to-side direction.

90. The apparatus recited in claim 89, wherein the portion of the binding engagement member includes a first section which extends along a first side of the snowboard boot.

91. The apparatus recited in claim 90, wherein the portion of the binding engagement member further includes a second section which extends along a second side of the snowboard boot.

92. The apparatus recited in claim 91, wherein the sole includes a first side and a second side that each extends between a toe portion and a heel portion of the boot, and the first section of the binding engagement member is attached to the first side of the sole.

93. The apparatus recited in claim 92, wherein the second section of the binding engagement member is attached to the second side of the sole.

94. The apparatus recited in claim 93, wherein the binding engagement member includes at least one cross member interconnecting the first and second sections thereof.

95. The apparatus of claim 94, in combination with the snowboard binding.

96. The apparatus recited in claim 46, wherein the at least one cross member includes at least a portion thereof that is circular in cross-section.

97. The apparatus recited in claim 91, wherein the binding engagement member is a single unitary member including both the first and second sections.

98. The apparatus of claim 91, in combination with the snowboard binding.

99. The apparatus recited in claim 89, wherein the sole includes a first side and a second side that extend between a toe portion and a heel portion of the boot, and the binding engagement member includes a first section and a second section which extend substantially parallel to the first and second sides, respectively.

100. The apparatus recited in claim 99, wherein the first and second sections of the binding engagement member are separated by a gap in the binding engagement member.

101. The apparatus recited in claim 89, wherein the snowboard boot has an in-step portion and the binding engagement member is positioned therealong.

102. The apparatus of claim 101, in combination with the snowboard binding.

103. The apparatus recited in claim 89, wherein the binding engagement member is a bar.

104. The apparatus recited in claim 89, wherein the snowboard boot includes a first side and a second side that each extends between a toe portion and a heel portion of the boot, at least one of the first and second sides having a recess therein, wherein a portion of the binding engagement member is exposed by the recess.

105. The apparatus of claim 104, in combination with the snowboard binding.

106. The apparatus recited in claim 104, wherein the section of the binding engagement member extends along a bottom portion of the recess.

107. The apparatus recited in claim 106, wherein at least an upper surface of the section is disposed within the recess and is engagable with the snowboard binding.

108. The apparatus of claim 107, in combination with the snowboard binding.

109. The apparatus recited in claim 104, wherein the recess is located in the sole.

110. The apparatus recited in claim 89, wherein the snowboard boot includes a first side and a second side that extend between a toe portion and a heel portion, the first side having a first recess therein and the second side having a second recess therein, wherein the portion of the binding engagement member includes a first section which extends along the first recess and a second section which extends along the second recess.

111. The apparatus recited in claim 110, wherein the first and second recesses are located in the sole.

112. The apparatus of claim 110, in combination with the snowboard binding.

113. The apparatus of claim 89, in combination with the snowboard binding.

114. The apparatus recited in claim 89, wherein the engageable portion of the binding engagement member is disposed at a sidewall of the snowboard boot.

115. The apparatus recited in claim 89, wherein the binding engagement member further includes a second portion that extends across a width of the snowboard boot.

116. The apparatus recited in claim 89, wherein the binding engagement member forms a stiffener that stiffens the sole, and that does not extend forward of an instep area of the sole so as to not impact flexibility of the sole forward of the instep area.

117. An apparatus, comprising:

a snowboard boot having an upper portion and a sole, the sole having a heel-to-toe direction and a side-to-side direction; and a binding engagement member supported within the sole and having a portion thereof extending in the heel-to-toe direction which is engageable with a snowboard binding to secure the snowboard boot to a snowboard;

wherein the binding engagement member includes at least one closed loop.

118. An apparatus, comprising:

a snowboard boot having an upper portion and a sole, the sole including a region corresponding to an in-step of a wearer of the snowboard boot, the snowboard boot having a heel-to-toe direction and a side-to-side direction; and a bar embedded within the sole and having a portion thereof that is disposed in the in-step region, extends in the heel-to-toe direction and is constructed and arranged for engagement with a snowboard binding;

wherein the portion of the bar that extends in the heel-to-toe direction is circular in a cross-section taken in the side-to-side direction.

119. The apparatus of claim 118, in combination with the snowboard binding.

120. An apparatus, comprising:

a snowboard boot having an upper portion and a sole, the snowboard boot having first and second lateral sidewalls, a heel area and a toe area, the snowboard boot having a heel-to-toe direction and a side-to-side direction; and at least one binding engagement member, connected to the snowboard boot, having a portion thereof that is engageable with a snowboard binding to secure the snowboard boot to a snowboard, the engageable portion of the at least one engagement member being disposed substantially in-line with one of the first and second lateral sidewalls of the snowboard boot;

wherein the apparatus includes at least one recess that is adapted to expose the engageable portion of the at least one engagement member, the engageable portion of the at least one engagement member being disposed within the recess;

wherein the engageable portion of the at least one engagement member extends in the heel-to-to direction; and wherein the engageable portion of the at least one engagement member extends in the heel-to-toe direction and is circular in a cross-section taken in the side-to-side direction.

121. An apparatus, comprising:

a snowboard boot having an upper portion and a sole, the sole having a heel-to-toe direction and a side-to-side direction; and a binding engagement member supported within the sole and having a portion thereof extending in the heel-to-toe direction which is engageable with a snowboard binding to secure the snowboard boot to a snowboard;

wherein the apparatus includes at least one opening that is adapted to receive a portion of a snowboard binding, the opening exposing the engageable portion of the binding engagement member.

122. The apparatus recited in claim 121, wherein the engageable portion of the binding engagement member forms a bottom surface of the opening.

123. An apparatus, comprising;

a snowboard boot having an upper portion and a sole, the sole including a region corresponding to an in-step of a wearer of the snowboard boot, the snowboard boot having a heel-to-toe direction and a side-to-side direction; and a bar embedded within the sole and having a portion thereof that is disposed in the in-step region, extends in the heel-to-toe direction and is constructed and arranged for engagement with a snowboard binding;

wherein the bar is circular in a cross-section taken in the side-to-side direction.

124. The apparatus recited in claim 123, wherein the binding engagement member further includes a second portion that extends in the side-to-side direction across a width of the snowboard boot.

* * * * *

UNITED STATES PATENT AND TRADEMARK OFFICE

CERTIFICATE OF CORRECTION

PATENT NO. : 6,050,005
DATED : April 18, 2000
INVENTOR(S) : Dodge, David

It is certified that error appears in the above-identified patent and that said Letters Patent is hereby corrected as shown below:

Column 5,
Line 50, after "thereof", please add -- ; and
wherein the at least one cross member includes first and second cross members interconnecting the first and second sections of the binding engagement member --.

Signed and Sealed this

Twenty-fifth Day of March, 2003

JAMES E. ROGAN
*Director of the United States Patent and Trademark Office*